US010244817B2

(12) United States Patent
Mandon et al.

(10) Patent No.: US 10,244,817 B2
(45) Date of Patent: Apr. 2, 2019

(54) SKI BOOT

(71) Applicant: ROSSIGNOL LANGE S.R.L., Montebelluna, Treviso (IT)

(72) Inventors: Florence Mandon, La Murette (FR); Tiziano Posato, Maser (IT)

(73) Assignee: ROSSIGNOL LANGE S.R.L., Montebelluna (IT)

( * ) Notice: Subject to any disclaimer, the term of this patent is extended or adjusted under 35 U.S.C. 154(b) by 29 days.

(21) Appl. No.: 15/478,338

(22) Filed: Apr. 4, 2017

(65) Prior Publication Data

US 2017/0280818 A1 Oct. 5, 2017

(30) Foreign Application Priority Data

Apr. 4, 2016 (EP) ..... 16425027

(51) Int. Cl.
*A43B 5/04* (2006.01)

(52) U.S. Cl.
CPC ..... *A43B 5/046* (2013.01); *A43B 5/0405* (2013.01); *A43B 5/0427* (2013.01)

(58) Field of Classification Search
CPC ..... A43B 5/0452; A43B 5/0427; A43B 5/046
USPC ..... 36/118.2, 118.4, 118.7, 118.8
See application file for complete search history.

(56) References Cited

U.S. PATENT DOCUMENTS 4,601,118 A * 7/1986 Zanatta ..... A43B 5/0466 36/118.2
4,611,415 A * 9/1986 Tonel ..... A43B 5/046 36/115
4,615,128 A * 10/1986 Borsoi ..... A43B 5/0454 36/118.7
5,363,572 A * 11/1994 Marega ..... A43B 5/0466 36/118.2
5,740,620 A * 4/1998 Giese ..... A43B 5/04 36/115
6,799,384 B1 * 10/2004 Grandin ..... A43B 5/0466 36/118.2
2011/0067271 A1 3/2011 Foxen et al.
2014/0215856 A1 * 8/2014 Sanderson ..... A43B 5/145 36/131

FOREIGN PATENT DOCUMENTS

EP 2 620 068 A1 7/2013
FR 2 847 173 A1 5/2004
WO 98/02057 A1 1/1998

OTHER PUBLICATIONS

European Search Report and Written Opinion dated Sep. 6, 2016 issued in counterpart application No. EP16425027; w/ English partial translation and partial machine translation (14 pages).

* cited by examiner

*Primary Examiner* — Marie D Bays
(74) *Attorney, Agent, or Firm* — Westerman, Hattori, Daniels & Adrian, LLP

(57) ABSTRACT

Ski boot with rigid shell comprising a lower shell (30) and a cuff (20) articulated in rotation to the lower shell (30), characterized in that it comprises at least a connecting ring (10) connecting the cuff (20) to the lower shell (30), this connecting ring (10) comprising a locking surface (11) collaborating with an opening (31) in the lower shell (30) so as to prevent the connecting ring (10) from rotating relative to the lower shell (30), and a rotation surface (12) collaborating with an opening (24) in the cuff so as to guide the rotation of the cuff (20) relative to the lower shell (30) about this second surface.

25 Claims, 4 Drawing Sheets

SECTION A-A

SKI BOOT

This application claims priority of European application No. EP16425027.6 filed Apr. 4, 2016, which is hereby incorporated by reference herein in its entirety.

The invention relates to a ski boot with a rigid shell comprising a lower shell and a cuff which are connected in an articulated manner using a connecting ring.

A ski boot demands high stiffness and strength because it is subjected to numerous loadings in use. High stiffness is also needed to achieve good boot performance as the boot, being the interface between the skier and the ski, transmits the load from the skier to the ski in order to steer the latter. However, the boot must also allow the skier to open it up in order to put it on and take it off and must allow him to bend his knees forward in order to ski. This flexion is achieved by the articulation between the cuff and the lower shell, the latter being secured to the ski. This arrangement requires an axis of articulation between the cuff and the lower shell, which axis plays an important part because it contributes to the transmission of load from the skier to the ski. Specifically, all the load passes from the cuff to the lower shell and then to the ski, chiefly via the articulation. On the other hand, this arrangement also makes it possible to determine the relative mobility between the cuff and the lower shell, or other parameters such as, for example, the angle of inclination, which likewise contributes to the comfort and overall performance of the boot.

Thus, a general object of the present invention is to propose an arrangement that allows optimized connection between a cuff and a lower shell, making it possible to optimize boot performance.

In particular, a first object of the present invention is to propose a ski boot that allows high-performance transmission of load from the skier to the ski.

An optional second object of the present invention is to propose a ski boot that allows adjustment of the inclination of the cuff with respect to the lower shell.

According to the concept of the invention, the boot achieves these objects by means of a special connecting ring that connects the cuff and the lower shell in an articulated manner, which guarantees good transmission of load and good ski boot behaviour. For that, the connecting ring comprises a locking surface arranged in an opening in the lower shell, so as to prevent the connecting ring from rotating relative to the lower shell, and a rotation surface arranged in an opening in the cuff so as to guide the rotation of the cuff relative to the lower shell about this second surface. This rotation surface advantageously has a large dimension.

The invention is more specifically defined by the claims.

These objects, features and advantages of the present invention will be explained in detail in the following description of one nonlimiting particular embodiment given in connection with the attached figures among which:

Figure 7A:
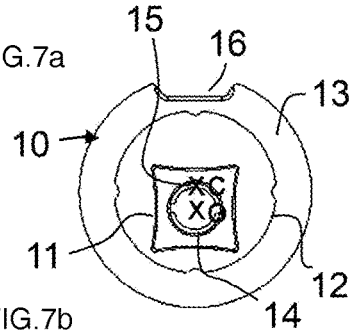
Figure 7B:
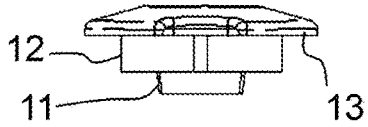
Figure 7C:
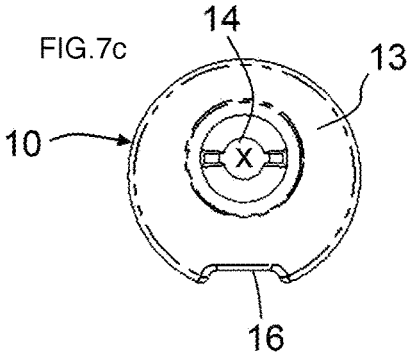

FIGS. 7*a* to 7*c* depict, respectively, a side view from the inside, a view from above and a side view from the outside, of a first connecting ring connecting a cuff to a lower shell of the ski boot according to the embodiment of the invention.

Figure 8A:
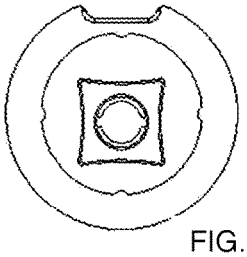
Figure 8B:
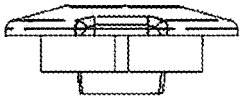
Figure 8C:
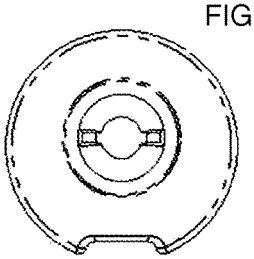

FIGS. 8*a* to 8*c* depict, respectively, a side view from the inside, a view from above and a side view from the outside, of a second connecting ring connecting a cuff to a lower shell of the ski boot according to the embodiment of the invention.

Figure 9A:
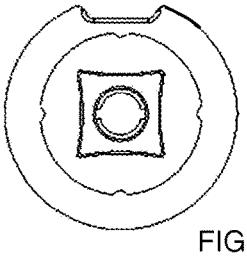
Figure 9B:
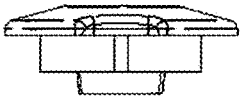
Figure 9C:
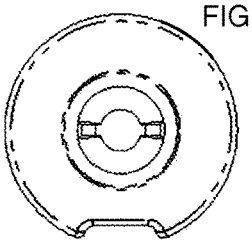

FIGS. 9*a* to 9*c* depict, respectively, a side view from the inside, a view from above and a side view from the outside, of a third connecting ring connecting a cuff to a lower shell of the ski boot according to the embodiment of the invention.

Figure 10:
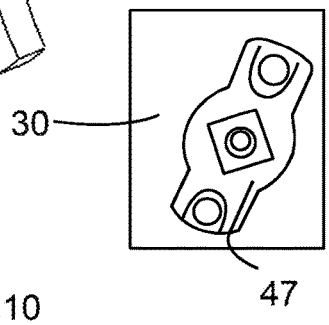
Figure 5:
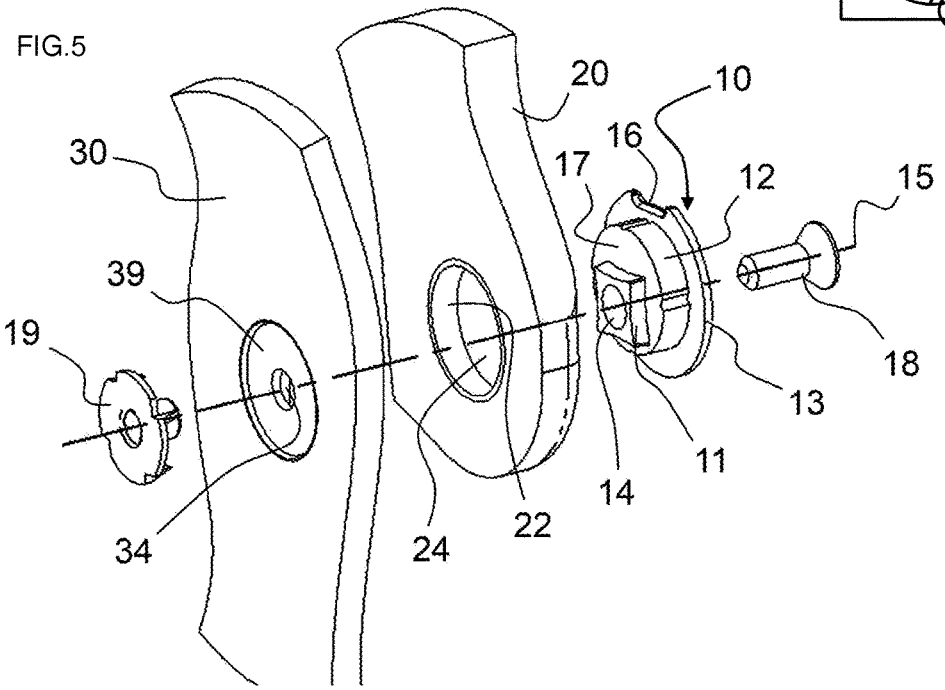

FIG. 10 depicts the connecting area of the lower shell according to a variant of the embodiment of the invention.

In the description which follows, the vertical direction denotes the direction from the bottom upwards, namely from the sole of the boot towards the top of the boot. The longitudinal direction denotes the direction perpendicular to the vertical direction, oriented from the rear towards the front of the boot. The transverse direction is the direction perpendicular to the longitudinal and vertical directions. The two, longitudinal and transverse, directions define a horizontal plane, in which the sole of the ski boot is more or less placed. The term "interior surface" will denote that surface of an element that faces towards the inside of the ski boot, on the foot side, and the term "exterior surface" will, on the other hand, denote a surface, of an element, that is oriented towards the outside of the ski boot.

In the description that follows, we shall use the same references in the various alternative forms of embodiment to denote the same features.

Figure 1:
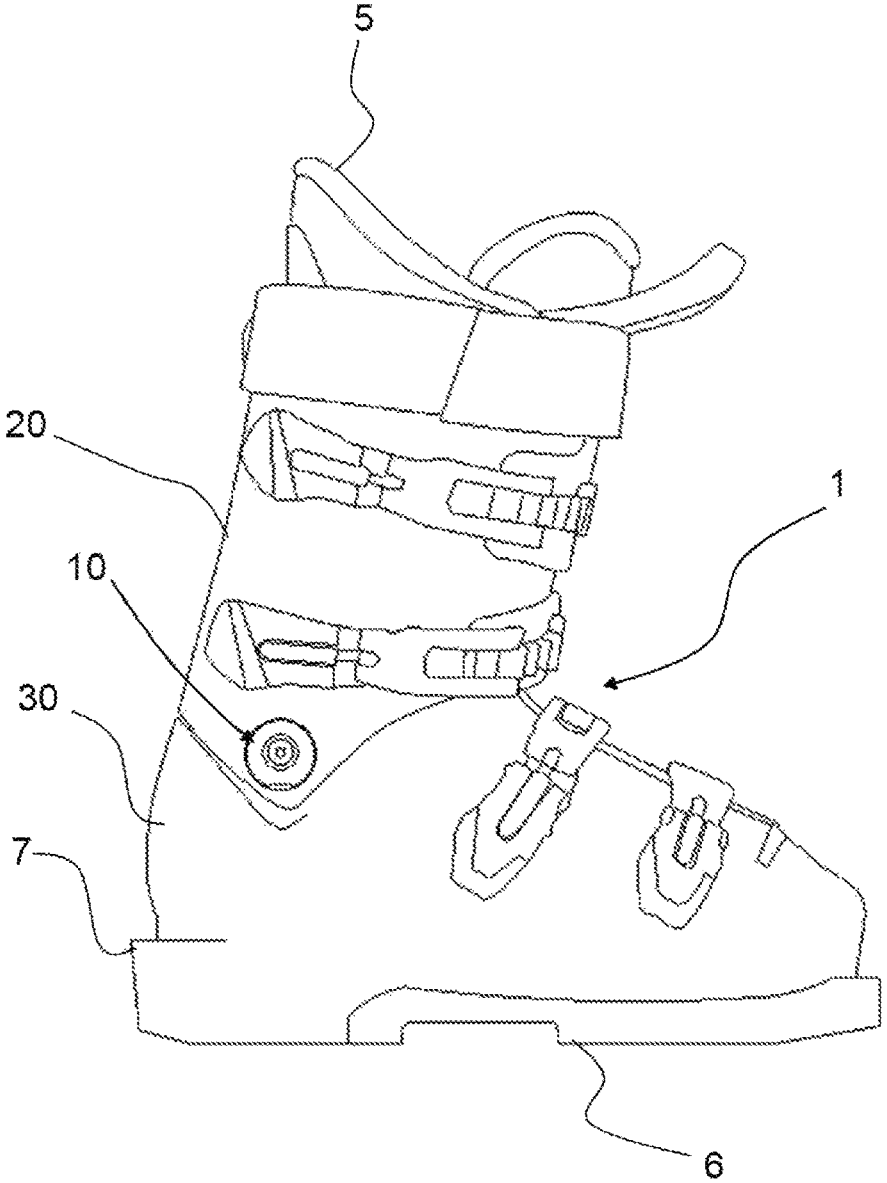
FIG. 1 depicts a side view of a ski boot according to one embodiment of the invention.
Figure 2:
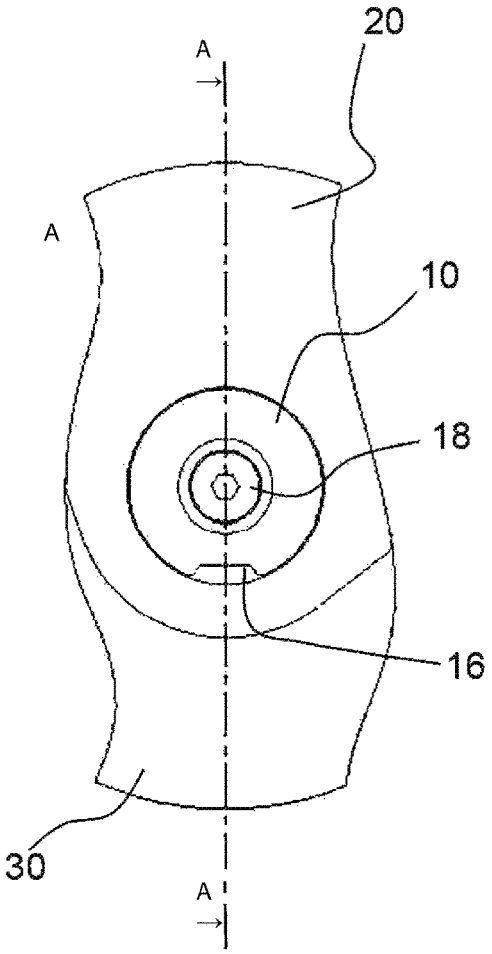
FIG. 2 depicts a side view from the outside, and enlarged in the region of the articulation between the cuff and the lower shell, of the ski boot according to the embodiment of the invention.

FIG. 1 illustrates an alpine ski boot 1 according to one embodiment of the invention, which comprises a rigid external shell, for example made of an injection-moulded plastics material, for example polyurethane, or polyamide, or even polyolefin. This rigid shell notably comprises a cuff 20 articulated to a lower shell 30 about a connecting axis by means of a connecting ring 10. The lower shell 30 extends, in the vertical direction, from the outsole 6 up to the level of the axis of articulation and connection with the cuff 20. This axis of articulation is positioned laterally, at a height substantially level with or slightly above the malleolus bone of the foot of a skier, or even level with his ankle. A comfort inner boot 5 is inserted into the rigid shell. The sole 6 is extended at its two, front and rear, ends by lugs 7 of a shape suited to collaborating with the jaws of a ski boot binding device, that allows the lower shell 30 to be secured to the ski, whereas the cuff 20 remains articulated about its substantially transverse axis of articulation with respect to the lower shell.

The invention relates more specifically to the articulated connection between the cuff 20 and the lower shell 30, via the connecting ring 10. FIGS. 2 to 5 more specifically illustrate the arrangement of the connection between the cuff 20 and the lower shell 30 according to the embodiment of the invention.

The lower shell 30 comprises a through-opening 34, of a dimension intended for the passage of a nut 19 from its interior surface. It additionally comprises an opening 31, which is a through-opening or, as an alternative, not a completely through-opening, arranged from its exterior surface. According to this embodiment, this opening 31 is not a through-opening and is of square cross section. The cuff 20 has a through-opening 24, formed from its interior wall, as a first cylindrical opening 22. The axis of rotation 15 of the cuff 20 with respect to the lower shell 30 corresponds to the axis which passes through the centre of the opening 24. From its exterior surface, the cuff 20 comprises a second cylindrical opening 23, which is not a through-opening, which means to say which does not extend through the entire thickness of the cuff 20. The two cylindrical openings 22, 23 of the cuff 20 form two coaxial cylinder portions with different diameters.

These openings arranged in the walls of the cuff 20 and of the lower shell 30 are intended to come into register with one another when the ski boot is being assembled. A connecting ring 10 is then arranged in these openings, to allow the articulated connection of the cuff 20 and of the lower shell 30.

The connecting ring 10 comprises three complementary parts in its thickness. This thickness is measured in the substantially transverse direction of the boot. This connecting ring 10 has a through-opening 14 the centre of which is aligned with the centre of the opening 34 made in the lower shell 30. As illustrated in FIGS. 1 to 5, according to this embodiment, the centre of the opening 14 corresponds to the axis of rotation 15 of the rotation surface 12, about which the cuff 20 rotates via its surface 22. More generally, in this embodiment, the centres of the openings 14, 24 and 34 are aligned with the axis of rotation 15. A first part of the connecting ring 10 forms a locking surface 11, intended to be housed in the opening 31 made in the exterior surface of the lower shell 30. In this embodiment, this locking surface 11 therefore has a cross section substantially close to a square, with dimensions corresponding to those of the corresponding housing in the lower shell 30. According to the embodiment of the invention, the blocking surface 11 of the ring 10 has a square cross section with a side length of between 0.7 and 1.5 centimeters, preferably 1 centimeter, and a thickness of between 0.1 and 0.7 centimeters, preferably 0.3 centimeters. It allows the connecting ring to be locked against rotation relative to the lower shell 30. Next, this connecting ring 10 comprises an intermediate cylindrical second part, forming a peripheral rotation surface 12, housed in the cylindrical opening 22 made from the interior surface of the cuff 20, the wall of which is intended to collaborate with very little clearance with this peripheral rotation surface 12 of the connecting ring 10. This arrangement allows the cuff 20 rotational mobility relative to the connecting ring 10, more particularly about the peripheral rotation surface 12, and therefore allows rotational mobility of the cuff 20 relative to the lower shell 30 about the axis of rotation 15. Finally, the third part 13 of the connecting ring 10 has a larger size, forming a head, which becomes housed in the opening 23 that is not a through-opening on the side of the exterior surface of the cuff 20, which forms an end stop for the connecting ring and prevents any relative movement of the connecting ring of the cuff in the transverse direction, and in particular prevents the cuff from exiting to the outside of the boot. This third part 13 has a cut-out 16 making it possible to view the orientation of the connecting ring 10. Furthermore, the cut-out 16 also allows the connecting ring 10 to be dismantled using a specific tool, for example a flat-head screwdriver. Next, a screw 18 is inserted into the connecting ring 10, through the through-opening 14 of the connecting ring, via the exterior surface of the ski boot, and collaborates with a nut 19 inserted opposite, via the interior surface of the lower shell of the boot. This assembly allows the connecting ring 10 to be secured to the ski boot.

Figure 3:
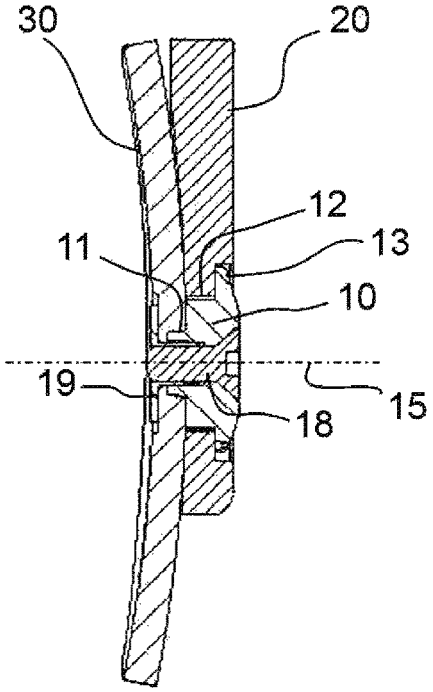
FIG. 3 depicts a view in cross section on a transverse vertical plane AA of the ski boot according to the embodiment of the invention.
Figure 4:
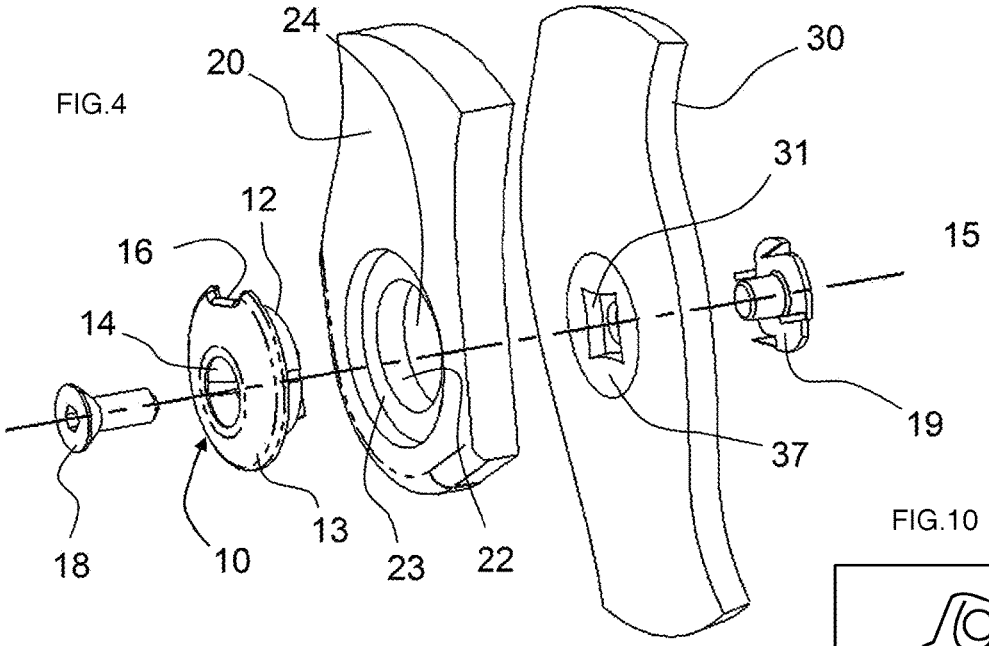
FIGS. 4 and 5 depict exploded perspective views from the outside and from the inside, respectively, of the arrangement of the articulation between the cuff and the lower shell of the ski boot according to the embodiment of the invention.

As is more particularly apparent in FIG. 3, the total thickness of the connecting ring 10 corresponds substantially to the thickness of the walls of the cuff 20 and of the lower shell 30, so that in the final position, the connecting ring 10 is substantially completely inserted into the thicknesses of these elements. In this zone, the thickness of the lower shell is generally comprised between 0.3 and 0.6 centimeters, preferably substantially equal to 0.4 centimeters, and the thickness of the cuff is generally comprised between 0.4 and 0.7 centimeters, preferably substantially equal to 0.5 centimeters. However, it would not constitute a departure from the scope of the invention if the connecting ring 10 were to have a protrusion positioned beyond the exterior surface of the cuff 20.

More specifically, the thickness of the first part that forms a locking surface 11 of the connecting ring corresponds to the thickness of the square-section opening 31 in the lower shell 30. The end of the connecting ring 10 thus comes into abutment within the thickness of the lower shell 30. This then establishes a connection without free play between the connecting ring 10 and the lower shell 30 and locks the ring against rotation with respect to the lower shell.

Next, the total thickness of the second and third parts 12, 13 of the connecting ring 10 corresponds substantially to the thickness of the wall of the cuff. The thickness of the second part is the greater, because it forms a cylindrical section the peripheral wall of which forms a rotation surface 12 for the cuff 20. The third part 13 comes into abutment against the outside, preventing any transverse movement of the connecting ring 10 relative to the cuff 20, and preventing the cuff from moving transversely outwards. It may be remarked that the frontal surface 17 of the second part comes into contact with the exterior surface of the lower shell, which is configured to form a planar accommodating surface 37 so as to ensure planar contact and optimal support.

In the embodiment of the invention where the connecting ring 10 is in metal, a metallic insert 47 can be fixed to the lower shell 30 at the level of the opening 31, so that to form a metal connecting surface or metal accommodating surface 37. In such variant of embodiment, represented by FIG. 10, the metal connecting ring 10 comes in a friction relation with a metallic surface of the metallic insert 47.

The connecting ring 10 adopts a monobloc form comprising a locking surface 11 and a rotation surface 12. In a simplified alternative form, it is possible for it not to have a head-forming third part 13, or for this part to be formed as a separate component, such as for example a washer or for example a part belonging to the screw 18. According to another alternative form, it is possible for the connecting ring 10 to adopt the form of several distinct elements, associated with one another. Naturally, the connecting ring 10 may adopt other shapes and features. Notably, the locking surface 11 could have a different cross section. Advantageously, this cross section takes the form of a polygon comprising between three and six sides, notably a quadrilateral, for example a square as depicted, or a hexagon.

The rotation surface is chosen to be large in size, and preferably has a greater surface area than the locking surface and/or has a cross section larger in size than the size of the cross section of the locking surface. The sides of this polygon may be rectilinear or even concave or curved.

The pull out strength of the ring in the shell is obtained by a sufficient thickness of locking surface, notably of the square shape, and a sufficient side length for the polygon, notably the square.

The connecting ring 10 may be made of a metallic material of the aluminium type, but may equally be made of plastic, particularly of fibre-reinforced plastic.

Figure 6:
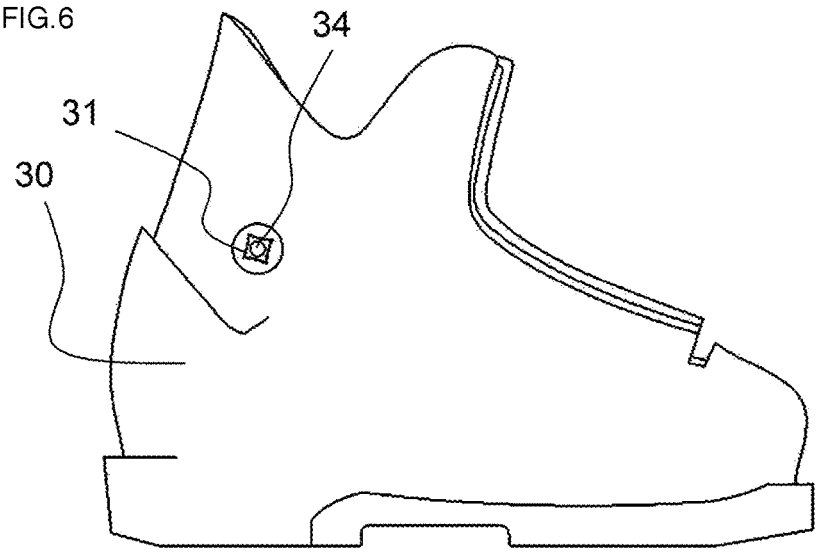
FIG. 6 depicts a side view of the lower shell of the ski boot according to the embodiment of the invention.

This construction offers the following advantages:

The rotation surface 12 about which the cuff effects a rotational movement is enlarged in comparison with the most commonplace solutions which rely on a single screw similar for example to the screw 18 in the embodiment, which acts as an axis of rotation of the cuff with respect to the lower shell. With the solution according to the invention, the circular cross section of the rotation surface may have a diameter greater than or equal to 1.5 centimeters, preferably greater than or equal to 1.9 centimeters, and a thickness of between 0.2 and 1 centimeter, preferably equal to 0.4 centimeters. This significant increase in the rotation surface makes it possible to achieve better transmission of load from the skier to the ski, and more stable cuff movement, notably due to a reduction in clearances;

The lower shell 30 and the cuff 20 have relatively simple forms. Their openings 24, 31 to accept the connecting ring 10 are obtained by machining, after they are formed by a conventional injection moulding method or are moulded-in, using a suitable mould. FIG. 6 thus illustrates the lower shell 30 according to the embodiment of the invention. It may be seen that its form remains simple and conventional, with no relief protruding beyond the exterior surface, as this would be complex to manufacture. On the contrary, the zone that accepts a connecting ring 10, notably the zone 31 intended to lock the locking surface 11 of the said connecting ring 10, has a simple shape recessed into the wall thickness of the lower shell 30.

According to an alternative form of the embodiment, the connecting ring 10 may also allow lateral adjustment of the inclination of the cuff 20 relative to the lower shell 30, with respect to a vertical longitudinal plane, so as to optimize the edge gripping and/or compensate for a specific build of skier. This inclination is also often referred to as "canting". For that, the connecting ring 10 has an eccentric architecture, which means to say that the centre o of the through-opening 14 of the connecting ring 10 and of its locking surface 11 does not coincide with the centre c of the rotation surface 12, positioned on the axis of rotation 15 about which the cuff 20 rotates, as depicted in FIGS. 7*a* to 7*c*. Thus, depending on the orientation of the locking surface 11 of the connecting ring 10 within the lower shell 30, for which there are four possibilities in the case of the square cross section envisaged with a connecting ring with an eccentric architecture, four different positions are obtained for the cuff 20 relative to the lower shell, because the centre c of rotation of this cuff is able to occupy four different positions about the centre o of the through-opening 14. Thus, this solution allows an adjusting process to be implemented which involves removing the connecting ring by unscrewing the screw 18, turning the connecting ring through the quarter-turn(s) chosen by the skier, then securing it in this new orientation using the screw 18. Another type of mechanical element for securing the connecting ring to the lower shell could be envisioned, of a clip-fastening type that is easy to undo.

FIGS. 8*a* to 8*c* illustrate a connecting ring according to another configuration in which the aforementioned eccentricity, namely the offset between the centre o of the through-opening of the locking surface 11 and the centre c of the rotation surface 12, is simply reduced. That allows a smaller-amplitude, finer, adjustment of the canting. By way of comparison, FIGS. 9*a* to 9*c* illustrate the connecting ring without eccentricity, as already described previously with reference to FIGS. 2 to 5. A skier may have all three connecting rings available for his boot and thus choose the connecting ring that appears to him to be best suited to his intended use of the ski boot. That gives him flexibility as to the possible adjustments of the canting of his boot.

The rings provided by the embodiment of the invention allow adjustment of the lateral inclination or canting of the cuff:

by 0°, which is a neutral position illustrated by the connecting ring in FIGS. 9*a* to 9*c;* by 0.5°, which is an intermediate inclination adjustment illustrated by FIGS. 8*a* to 8*c;* up to 1°, which is the maximum inclination that can be achieved and is illustrated in FIGS. 7*a* to 7*c*. Greater adjustments in inclination could be achieved with rings exhibiting greater eccentricity, without departing from the scope of the invention.

Finally, with the solution according to this alternative form of embodiment of the invention, the ski boot can be manufactured without additional cost, according to a conventional method, and offers the advantage of better performance through an enlarged rotation surface of the cuff, while at the same time offering the option of canting adjustment that is easy to perform and a mechanical integrity of the whole which is achieved by the locking surface of the ring inserted into a shape hollowed into the lateral sides of the lower shell.

The connecting ring as described hereinabove may be used on each lateral side of the boot or, as an alternative, on just one side, it being possible for the other side to be fitted with a different conventional connection. Likewise, rings of greater or lesser eccentricity may be used in combination, such as, for example, a 0° ring, neutral ring, on one of the lateral sides of the boot, combined with a 0.5° ring on the other lateral side of the boot. There are thus multiple possibilities for adjusting the inclination of the cuff.

The invention claimed is:

1. Ski boot with rigid shell comprising:

a lower shell, a cuff articulated in rotation to the lower shell, at least one connecting ring connecting the cuff to the lower shell, the connecting ring being inserted in a first opening in the lower shell, and in a second opening in the cuff, the connecting ring comprising:

a locking surface collaborating with a corresponding locking surface which is part of a surface of the first opening in the lower shell, so as to prevent the connecting ring from rotating relative to the lower shell, and a rotation surface collaborating with the second opening in the cuff, so as to guide the rotation of the cuff relative to the lower shell about the rotation surface.

2. Ski boot according to claim 1, wherein the connecting ring comprises a third surface resting on a stop-forming surface of the cuff preventing outward transverse movement of the cuff relative to the connecting ring.

3. Ski boot according to claim 1, wherein the lower shell and the cuff comprise mutually-facing through-openings at the level of their connection by the connecting ring, the connecting ring also comprising a through-opening accepting a mechanical element of a screw and nut assembly that fixes the connecting ring to the lower shell.

4. Ski boot according to claim 1, wherein the locking surface of the connecting ring has a cross section of substantially polygonal shape comprising between three and six sides.

5. Ski boot according to claim 1, wherein at least one selected from the group consisting of (i) the rotation surface has a larger surface area than the locking surface, and (ii) the rotation surface has a cross section which is larger in size than the size of the cross section of the locking surface.

6. Ski boot according to claim 1, wherein the axis of rotation of the rotation surface of the connecting ring is offset from the centre of the locking surface of the connecting ring so that the connecting ring forms an eccentric allowing the adjustment of the inclination of the axis of rotation of the cuff relative to the lower shell.

7. Ski boot according to claim 1, wherein the rotation surface has a diameter greater than or equal to 1.9 centimeters.

8. Ski boot according to claim 1, wherein the rotation surface of the connecting ring extends in a direction of a thickness of the cuff over a distance less than the thickness of the cuff.

9. Ski boot according to claim 1, wherein the locking surface of the connecting ring extends in a direction of a thickness of the lower shell over a distance less than the thickness of the lower shell.

10. Ski boot according to claim 1, wherein the connecting ring has a monobloc form constituting a single component, the locking surface and the rotation surface belonging to the one single component.

11. Ski boot according to claim 1, comprising a single connecting ring on one side of the boot.

12. Ski boot according to claim 1, comprising two connecting rings distributed one on each side of the boot.

13. Ski boot according to claim 4, wherein the locking surface of the connecting ring has a square or hexagonal cross section.

14. Ski boot according to claim 11, wherein the connecting ring is configured to be positioned level with or above a location of a malleolus bone of a skier wearing the ski boot or level with a location of an ankle of a skier wearing the ski boot.

15. Ski boot according to claim 2, wherein the lower shell and the cuff comprise mutually-facing through-openings at the level of their connection by the connecting ring, the connecting ring also comprising a through-opening accepting a mechanical element comprising a screw and nut assembly that fixes the connecting ring to the lower shell.

16. Ski boot according to claim 2, wherein the locking surface of the connecting ring has a cross section of substantially polygonal shape comprising between three and six sides.

17. Ski boot according to claim 3, wherein the locking surface of the connecting ring has a cross section of substantially polygonal shape comprising between three and six sides.

18. Ski boot according to claim 2, wherein at least one selected from the group consisting of (i) the rotation surface has a larger surface area than the locking surface, and (ii) the rotation surface has a cross section which is larger in size than the size of the cross section of the locking surface.

19. Ski boot according to claim 3, wherein at least one selected from the group consisting of (i) the rotation surface has a larger surface area than the locking surface, and (ii) the rotation surface has a cross section which is larger in size than the size of the cross section of the locking surface.

20. Ski boot according to claim 4, wherein at least one selected from the group consisting of (i) the rotation surface has a larger surface area than the locking surface, and (ii) the rotation surface has a cross section which is larger in size than the size of the cross section of the locking surface.

21. Ski boot with rigid shell comprising:

a lower shell, a cuff articulated in rotation to the lower shell, at least one connecting ring connecting the cuff to the lower shell, the connecting ring comprising:

a locking surface collaborating with an opening in the lower shell so as to prevent the connecting ring from rotating relative to the lower shell, and a rotation surface collaborating with an opening in the cuff so as to guide the rotation of the cuff relative to the lower shell about the rotation surface, wherein the locking surface of the connecting ring has a cross section of substantially polygonal shape comprising between three and six sides.

22. Ski boot according to claim 21, wherein the locking surface of the connecting ring has a square or hexagonal cross section.

23. Ski boot according to claim 21, wherein the connecting ring comprises a third surface resting on a stop-forming surface of the cuff preventing outward transverse movement of the cuff relative to the connecting ring.

24. Ski boot according to claim 21, wherein the lower shell and the cuff comprise mutually-facing through-openings at the level of their connection by the connecting ring, the connecting ring also comprising a through-opening accepting a mechanical element of a screw and nut assembly that fixes the connecting ring to the lower shell.

25. Ski boot according to claim 21, wherein at least one selected from the group consisting of (i) the rotation surface has a larger surface area than the locking surface, and (ii) the rotation surface has a cross section which is larger in size than the size of the cross section of the locking surface.

* * * * *